United States Patent [19]

Blaskowski

[11] 4,270,493

[45] Jun. 2, 1981

[54] STEAM GENERATING HEAT EXCHANGER

[75] Inventor: Henry J. Blaskowski, West Simsbury, Conn.

[73] Assignee: Combustion Engineering, Inc., Windsor, Conn.

[21] Appl. No.: 1,621

[22] Filed: Jan. 8, 1979

[51] Int. Cl.[3] ..... F28D 7/00; C10K 1/02

[52] U.S. Cl. ..... 122/7 R; 48/77; 55/269; 165/143; 165/144

[58] Field of Search ..... 48/128, 77; 165/143, 165/144; 122/7 R; 55/269

[56] References Cited

U.S. PATENT DOCUMENTS

| | | | |
|---|---|---|---|
| 2,239,895 | 4/1941 | Kuhner | 122/7 |
| 2,603,559 | 7/1952 | Patterson | 48/196 |
| 3,333,630 | 8/1967 | Charcharos | 165/158 |
| 3,662,717 | 5/1972 | Haar | 122/7 R |
| 4,029,054 | 6/1977 | Schuurman | 122/7 R |
| 4,098,324 | 7/1978 | Kummel et al. | 122/7 R |

FOREIGN PATENT DOCUMENTS

| | | |
|---|---|---|
| 2611949 | 9/1977 | Fed. Rep. of Germany . |
| 2705558 | 8/1978 | Fed. Rep. of Germany . |
| 2801574 | 12/1978 | Fed. Rep. of Germany . |
| 1535337 | 6/1968 | France . |

OTHER PUBLICATIONS

Brennstof-Warme-Kraft, vol. 28, No. 1,32, Feb., 1976, pp. 57-60, Anwer et al., "Kohlevergasung im Fluidatbett (Winkler-Vergasung) unter Druck".

*Primary Examiner*—Peter F. Kratz
*Attorney, Agent, or Firm*—William W. Habelt

[57] ABSTRACT

A steam generating heat exchanger of modular design for cooling a high pressure, hot combustible gas laden with molten ash particles comprising a first convective cooler having a vertically orientated U-shaped gas pass housing a superheater and an evaporator, a radiant cooler disposed upstream of the first convective cooler and a second convective cooler housing an economizer disposed downstream of the first convective cooler. In-line tube bundles form the superheater, evaporator, and the economizer thereby minimizing ash deposition upon the heat transfer surface. The gas velocity within the radiant cooler is maintained low enough to permit molten ash particles entrained in the gas to coalesce and precipitate out of the gas stream, while the gas velocity within the convective coolers is maintained high enough to discourage ash deposition upon the heat transfer surface.

3 Claims, 7 Drawing Figures

STEAM GENERATING HEAT EXCHANGER

BACKGROUND OF THE INVENTION

The present invention relates to an apparatus for cooling a high pressure, hot gas laden with ash particles, and more particularly to a heat exchanger design for recovering heat from the high temperature combustible product gas produced in a pressurized coal gasifier, and for utilizing the heat recovered from the gas to produce superheated steam.

A number of coal gasification schemes have been developed in the past few years which produce a combustible product gas which can be ungraded to pipeline quality to supplement our nation's natural gas resources. The chemical reactions occurring in these gasification processes typically occur at temperatures ranging from 2000° to 3000° F. Further, pressures in the range of 250 to 1500 psi are required in order to satisfy system requirements. Other gas cleaning and processing steps are required subsequent to the gasification reaction to produce a product gas suitable for pipeline transmission. Prior to these gas cleaning and processing steps, it is necessary to cool the product gas leaving the gasification chamber from a temperature as high as 3000° F. to a much lower gas handling temperature typically on the order of 400° to 600° F.

A major problem associated with the cooling of the gas leaving the gasification chamber is the high concentration of molten ash in the product gas. Special precautions must be taken to avoid plugging of the heat exchanger with accumulated ash deposits which would adversely affect heat transfer and pressure drop through the heat exchange section.

An additional problem associated with cooling the product gas in a pressurized gasifier is that the reduced gas volume associated with the high gas pressures results in extremely high ash loadings. Typical ash loadings encountered in pressurized gasifier heat exchange sections exceed 500 pounds ash per hour per foot squared of flow area as compared to typical ash loadings of 10 to 50 pounds ash per hour per square foot of flow area in conventional coal fired power plant heat exchanger surface.

SUMMARY OF THE INVENTION

The steam generating heat exchanger of the present invention incorporates a modular design comprising: a first pressure containment vessel housing convective heat transfer surface, a second pressure containment vessel enclosing a radiation cooling chamber disposed upstream with respect to gas flow of the first vessel, and a third pressure containment vessel housing additional convective heat transfer surface located downstream with respect to gas flow of the first vessel. The unique features incorporated into each of these vessels and into the combination as a whole provide for the maximum amount of heat transfer surface in a minimum volume while minimizing the ash handling problems generally associated with cooling the hot gases from a pressurized coal gasifier, which are typically laden with entrained molten ash particles.

A first pressure containment vessel having a vertically orientated U-shaped gas pass houses both a superheater and an evaporator tube bundle section. The superheater section comprises an in-line tube bundle disposed in the first vertical leg of the U-shaped gas pass and the evaporator section comprises an in-line tube bundle disposed in the second vertical leg of the U-shaped gas pass such that the hot gas entering the vessel passes down the first vertical leg through the superheater surface and then turns upward and passes up through the evaporator section in the second vertical leg to the gas outlet of this vessel. An ash hopper is incorporated in the bottom of this vessel to collect ash particles which precipitate out of the gas flow as the gas flow turns upward at the bottom of the gas pass.

A second cylindrical pressure containment vessel is disposed upstream of the first pressure vessel and defines a radiant cooling chamber wherein the hot gas leaving the gasification section of the coal gasifier is cooled through predominately radiative heat transfer to a gas temperature low enough to insure that only dry ash particles will be present in the hot gas leaving the radiation chamber and entering the superheater section of the first pressure vessel. This second pressure vessel is designed such that the hot gases flow vertically upward through the radiation chamber at a velocity low enough to permit a major portion of the molten ash particles in the hot gas to coalesce into larger particles and drop vertically downward through the gas inlet to the radiation chamber to an ash hopper integral with the second pressure vessel.

A third cylindrical pressure containment vessel, disposed downstream of the first pressure vessel, houses an in-line economizer tube bundle. The gas leaving the evaporator section passes vertically downward through the economizer tube bundle and leaves the economizer section and passes to the gas handling and processing equipment at a gas temperature of 400° to 600° F. An ash hopper is disposed at the bottom of the third pressure vessel to collect ash particles which precipitate out of the gas as the gas passes vertically downward through the economizer tube bundle.

DESCRIPTION OF THE PREFERRED EMBODIMENT

Figure 1:
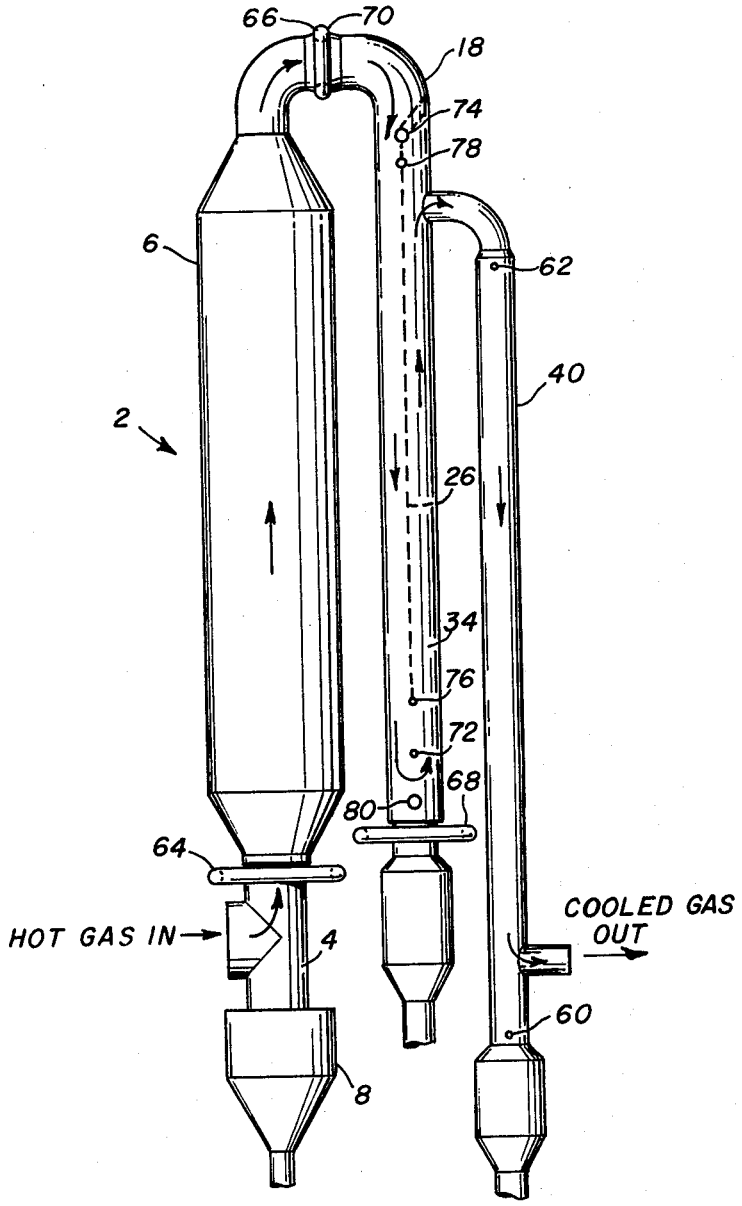
FIG. 1 is a general arrangement view of a steam generating heat exchanger designed in accordance with the invention.

The steam generating heat exchanger of the present invention incorporates an unique modular design comprised of three separate pressure containment vessels; a radiant cooler 6, a first convective cooler 18, and a second convective cooler 40, shown in FIG. 1, each vessel housing specific heat exchanger surface and incorporating specific features for handling a hot gas having a very high entrained ash concentration, such as the product gas from a pressurized coal gasifier. Coal is gasified in a gasification chamber, not shown, at a pressure of 250 to 1500 psi in a known manner to produce a combustible product gas. The gas leaves the gasification chamber at a temperature of 2500° to 3000° F. and is passed to the steam generating heat exchanger for cooling prior to subsequent gas cleaning and processing operations downstream of the heat exchanger.

As shown in FIG. 1, the hot gas from the gasification chamber is passed into steam generating heat exchanger 2 through refractory lined inlet tee 4. The hot gas from the gasification chamber enters the inlet tee horizontally and turns 90° passing vertically upward out of inlet tee into the radiant cooler 6 of steam generating heat exchanger 2. It is estimated that approximately 50 percent of the ash particles entrained in the hot gas entering inlet tee 4 will precipitate out of the gas stream as the gas stream turns upward to enter the radiant cooler. This ash will drop vertically downward out of the inlet tee for collection in slag/ash hopper 8 disposed directly beneath and secured to inlet tee 4.

Figure 2:
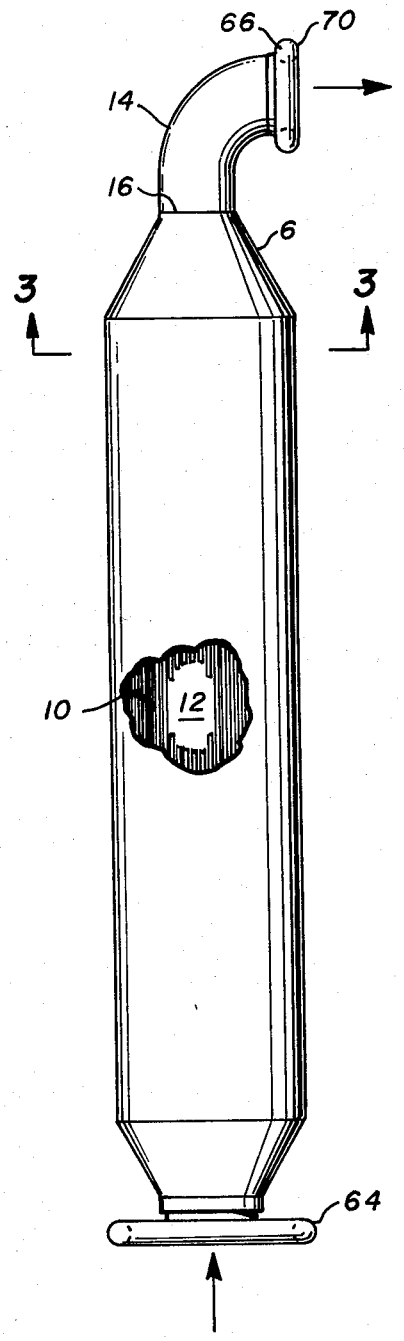
FIG. 2 is an enlarged sectional side view showing the details of the radiant cooler vessel.
Figure 3:
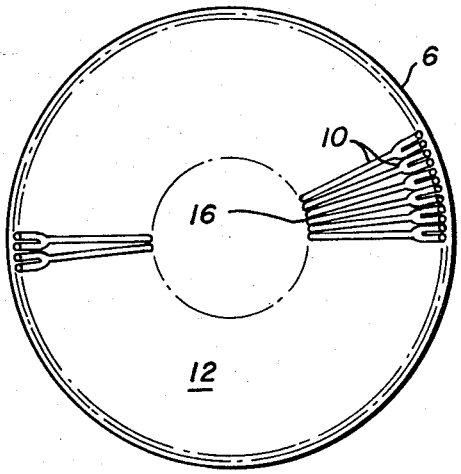
FIG. 3 is a sectional plan view of the radiant cooler vessel along line 3—3 of FIG. 2.

The hot gas entering radiant cooler 6 will be laden with molten ash particles since the temperature of the hot gas at this point will range from 2500° to 3000° F., which is typically above the fusion temperature of the ash particles entrained in the hot gas. Accordingly, the interior of radiant cooler 6 is lined, as shown in FIGS. 2 and 3, with a plurality of heat exchange tubes 10, formed into a welded waterwall, defining a radiation chamber 12 which the hot gas must traverse as it passes through a radiant cooler 6. The hot gas passing through radiation chamber 12 is cooled by the evaporation into steam of water circulated through heat exchanger tubes 10 so that the gas leaving the radiant chamber is at a temperature sufficiently below the initial deformation temperature of the entrained ash particles to insure that only dry ash particles remain in the hot gas leaving the radiant cooler. Preferably, the temperature of the hot gas leaving radiation chamber 12 is 1800° F.

As shown in FIG. 2, radiation chamber 12 of radiation cooler vessel 6 is comprised of a divergent inlet throat, a vertically elongated cylindrical body, and a convergent outlet throat. The hot gas entering the radiant cooler vessel is decelerated as it passes through the divergent inlet throat of heat chamber 12 to a low velocity. As the hot gas passes vertically upward through the cylindrical body of radiation chamber 12 and loses heat to the water-cooled heat exchange tubes 10, the gas cools and the gas velocity drops further. Preferably, the gas velocity within the radiant radiation chamber 12 is less than 2 feet per second. This low gas velocity serves not only to insure sufficient residence time within the radiation chamber for the proper cooling of the gas, but more importantly to promote the coalescence of ash particles entrained in the hot gas stream into larger, ergo heavier gas particles which with the aid of gravity will precipitate out of the low velocity gas stream and drop downward out of the radiant cooler vessel into the slag/ash hopper.

The water-cooled heat exchange tubes 10 are formed into a welded waterwall lining the interior of radiant cooler 6, which in addition to defining a radiation chamber for the cooling of the hot gases, protects the interior of the pressure vessel of radiant cooler 6 from radiation from the high temperature gas stream and from contact with the high temperature gas stream which, when the raw product of a coal gasification process, will contain gas species such as hydrogen and hydrogen sulfide which at such high gas temperatures would be extremely corrosive to the interior surface of the pressure vessel of radiant cooler 6. As shown in FIG. 3, the water-cooled heat exchange tubes 10 are bifurcated at their upper ends so as to pass through the convergent outlet throat and outlet duct 14 to outlet header 66. Although not shown, the water-cooled heat exchange tubes 10 are similarly bifurcated at their lower ends so as to pass through the divergent inlet throat to inlet ring header 64. Thus, heat exchange tubes 10 form a continuous welded waterwall to insure that the temperature of the pressure vessel shell remains low and uniform along its entire length thereby safeguarding the structural integrity of this pressure containment vessel. Further, the weld deposit joining individual heat exchange tubes together prevents ash particles from depositing upon the interior of the pressure vessel in the gap between adjoining tubes thereby protecting the pressure vessel from corrosive attack by the ash particles.

Gas leaving radiant cooler 6 is accelerated through convergent outlet throat of radiation chamber 12 into outlet duct 14, which mates to a first convective cooler 18, to a gas velocity which is high enough to discourage the dry ash particles in the gas from depositing upon and fouling downstream heat transfer surface and to maintain a high rate of heat transfer from the gas as it passes over the downstream heat transfer surface. For proper acceleration, it is preferred that the outlet flow area 16 of the convergent outlet throat of radiation chamber 12 be approximately 10 to 20 percent of the flow area of a cylindrical body of radiation chamber 12 as shown in FIG. 3.

Figure 4:
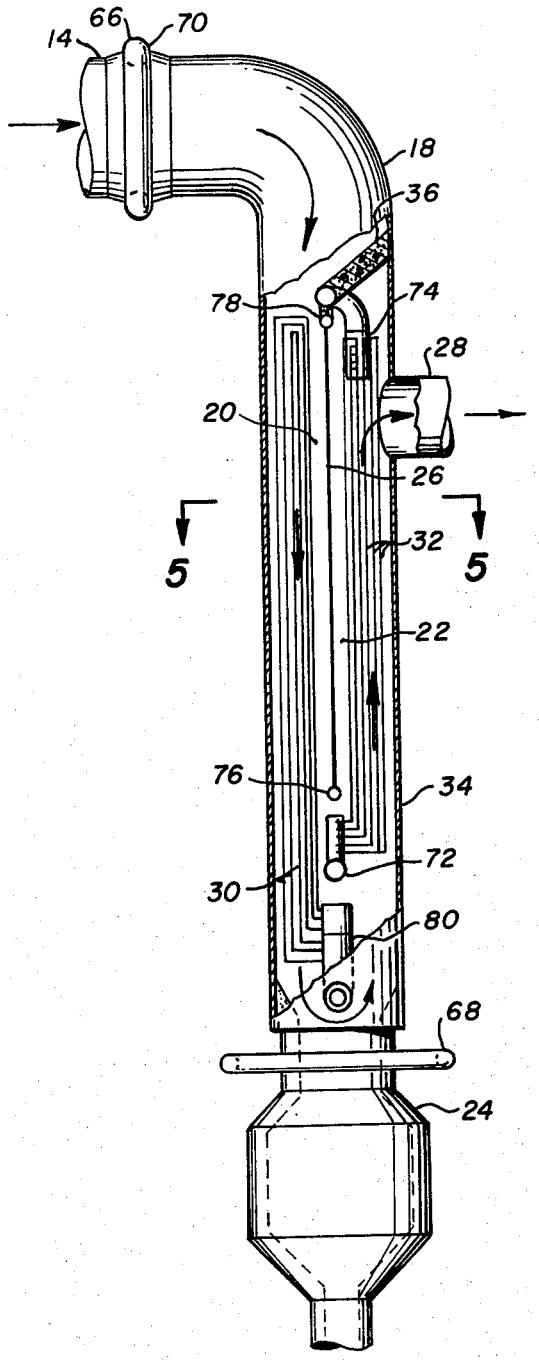
FIG. 4 is an enlarged sectional side view showing the details of the superheater/evaporator vessel.
Figure 5:
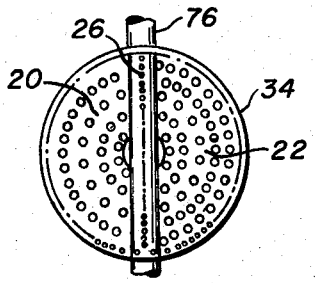
FIG. 5 is a sectional plan view of the superheater-/evaporator vessel along line 5—5 of FIG. 4.

According to the invention, the first convective cooler 18, as shown in FIGS. 4 and 5, comprises a vertically elongated cylindrical pressure containment vessel sectioned along its axis by a means impervious to gas flow so as to define a vertically upright U-shaped gas pass therein. The gas leaving the radiation cooler through outlet duct 14 passes vertically downward through the first leg 20 of U-shaped gas pass over heat transfer surface 30, thence turns 180° and passes vertically upward through the second leg 22 of the U-shaped gas pass over heat transfer surface 32, exiting the first convective cooler through outlet duct 28. An ash hopper 24 is disposed directly below and secured to the first convective cooler 18 to collect ash particles which precipitate out of the gas stream as the gas stream turns 180° and begins to flow upward against the force of gravity.

Although the first convective cooler 18 may be sectioned into a U-shaped gas pass by any means impervious to gas flow, such as a refractory tile wall, it is preferred that the sectioning means also serve as gas cooling surface. Accordingly, in the preferred embodiment of the present invention, a water-cooled center wall 26 formed of a plurality of heat transfer tubes welded side to side is disposed along the axis of a first convective cooler thereby defining a U-shaped gas pass therein. Additionally, a gas impervious refractory baffle tile 36 is disposed across the top of the second leg 22 of the gas pass between the top center wall 26 and the interior wall of the first convective cooler to insure that all the gas entering a first convective cooler passes down the first leg 20 of the gas pass and does not interfere with the upward gas flow in the second leg 22 of the gas pass.

As mentioned hereinbefore, the gas leaving radiant cooler 6 is cooled to a temperature sufficiently below the initial deformation temperature of the ash particles entrained in the gas stream to insure that only dry ash particles enter the first convective cooler 18. Since the ash particles are no longer molten, heat transfer surface from this point on will not be subject to slagging but will be subject to fouling, i.e., the deposition of dry ash deposits upon heat transfer surface which acts as a thermal barrier and reduces heat transfer efficiency. Accordingly, heat transfer surface 30 and 32, disposed respectively in the first leg 20 and the second leg 22 of the U-shaped gas pass of first convective cooler 18, are each formed of a bundle of in-line tubes, i.e., a plurality of heat transfer tubes disposed parallel to the gas flow pass. This orientation of the heat transfer surface serves to minimize the contact between entrained ash particles and the tube surface thereby minimizing the fouling of the heat transfer surface. In the preferred embodiment of the invention, heat transfer surface 30 disposed in the first leg 20 of the gas pass is a steam-cooled superheater and heat transfer surface 32 disposed in the second leg 22 of the gas pass is a water-cooled evaporator.

Fouling of heat transfer surface in first convective cooler 18 is further minimized by providing a relatively high gas velocity through in-line tube bundles 30 and 32. According to the invention, the gas entering the first convective cooler has been accelerated through the conversion outlet throat of radiation chamber 12. Since the first convective cooler is sectioned along its axis into a U-shaped gas pass, the gas entering the first leg 20 and the second leg 22 of the gas pass is further accelerated to twice the velocity of the gas at the inlet to the first convective cooler. Preferably, the gas entering the in-line tube bundles 30 and 32 has a velocity greater than 15 feet per second. Such a velocity would discourage the fouling of a heat transfer tube and also result in high convective heat transfer rates.

As with the radiant cooler, the interior wall of the cylindrical pressure containment vessel comprising the first convective cooler is lined, as shown in FIGS. 4 and 5, with a plurality of water-cooled heat exchange tubes 34, formed into a welded waterwall, which insures that the temperature of a first convective cooler vessel remains low and uniform along its entire length and which protects the interior surface of the vessel from contact with the potential corrosive gas.

Figure 6:
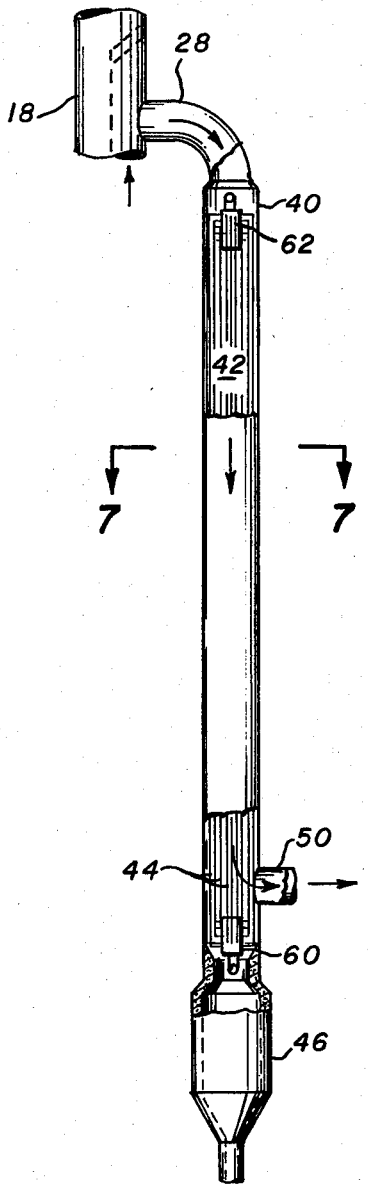
FIG. 6 is an enlarged sectional side view showing the details of the economizer vessel.
Figure 7:
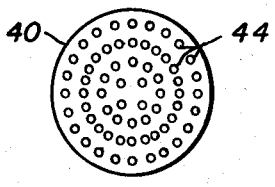
FIG. 7 is a sectional plan view of the economizer vessel along line 7—7 of FIG. 6.

The gas leaving the first convective cooler passes through connector duct 28 to a second convective cooler 40 at a temperature of less than 800° F. The second convective cooler 40, as shown in FIGS. 6 and 7, comprises a vertically elongated cylindrical pressure containment vessel defining a single gas pass 42 and a heat transfer surface 44 disposed therein. The gas stream enters the second convective cooler through connector duct 28, thence passes vertically downward through gas pass 42 over heat transfer surface 44, turns 90° and exits the second convective cooler 40 horizontally through outlet duct 50. An ash hopper 46 is disposed directly beneath and secured to the second convective cooler 40 to collect the ash particles which precipitate out of the gas stream as the gas stream turns 90° to horizontally exit the second convective cooler.

By insuring that the gas leaves the first convective cooler less than 800° F., the necessity of lining the interior walls of the cylindrical pressure vessel comprising the second convective cooler is eliminated. At temperatures below 800° F., it is no longer necessary to cool the vessel walls in order to insure structural integrity. Nor is it necessary to protect the interior surface of the vessel from contact with the gas since the potential corrosive activity of the gas would be insignificant at such a low temperature.

Fouling of heat transfer surface in the second convective cooler 40 due to the presence of dry ash particles in the gas is minimized by again utilizing in-line tubes to form the heat transfer surface 44 disposed in gas pass 42 of the second convective cooler. In the preferred embodiment, the heat transfer surface 44 of the second convective cooler is an economizer. Although maintaining a high gas velocity through the heat transfer surface of the second convective cooler is not as critical as it is in the first convective cooler because of the reduced fouling tendency at the low temperatures present in the second convective cooler, it is preferred that the gas velocity through heat transfer surface 44 be in the range of 10 to 15 feet per second.

As mentioned previously, the hot gas generated during the coal gasification process is cooled by generating steam in the water-cooled tubes and by superheating steam in the steam-cooled tubes of the present invention. In the preferred embodiment, the cooling fluid passes through the heat exchanger tubes via natural circulation. Referring to FIG. 1, feedwater is passed through the economizer inlet header 60, heated as it flows vertically upward through heat transfer surface 44, collecting in economizer outlet header 62 and passed to a steam drum, not shown. A first portion of the saturated water collected in the steam drum is passed to the radiant cooler waterwall inlet ring header 64, heated and evaporated as it flows vertically upward through heat exchange tubes 10 lining the interior of the radiant cooler 6, collected in the radiant cooler waterwall outlet header 66, and passed to the steam drum where steam generated and heat exchanged tubes 10 are separated from the steam/water mixture collected in the radiant cooler waterwall outlet header.

A second portion of the saturated water collected in the steam drum is passed to the first convective cooler inlet ring header 68, heated and evaporated as it flows vertically upward through heat exchange tubes 34 lining the interior of first convective cooler 18, collected in the first convective cooler waterwall outlet header 70, and passed to the steam drum for separation. A third portion of the water collected in the steam drum is passed to the evaporator inlet header 72, heated and evaporated as it flows vertically upward through heat exchange surface 32, collected in the evaporator outlet header 74, and passed to the steam drum for separation.

When, as in the preferred embodiment of the present invention, water-cooled center wall 26 is used to section the first convective cooler 18 into a U-shaped gas pass, a fourth portion of the water collected in the steam drum is passed to the center wall inlet header 76, heated and evaporated as it flows vertically upward through water-cooled center wall 26, collected in the center wall outlet header 78, and passed to the steam drum for separation.

Steam collected in the steam drum is passed through the inlet header portion of the superheater inlet/outlet header 80, dried and superheated to the desired superheat temperature as it passes through heat exchange tubes 30, collected in the outlet header portion of the superheater inlet/outlet header 80 and passed out of the steam generating heat exchanger for use in the coal gasification process itself or for auxiliary power generation.

While the preferred embodiment of the invention has been illustrated and described, it is to be understood that the invention should not be limited thereto.

What is claimed is:

1. A steam generating heat exchanger of modular design for cooling a high pressure, hot combustible gas laden with molten ash particles, comprising:

a. a first convective cooler comprising a vertically orientated cylindrical pressure containment vessel having a gas inlet in the top thereof, a gas outlet in the side thereof and located near the top thereof, and means disposed between the gas inlet and the gas outlet and extending along the axis of the first convective cooler for establishing a U-shaped gas pass therein so that the hot gas passes from the gas inlet down the first leg of the gas pass and up the second leg of the gas pass to the gas outlet;

b. a plurality of heat exchange tubes lining the interior of said first convective cooler;

c. a first in-line tube bundle disposed in the first gas pass of said first convective cooler;

d. a second in-line tube bundle disposed in the second gas pass of said first convective cooler;

e. means for receiving ash particles precipitating out of the hot gas flowing thru said first cooler, said means disposed beneath, secured to and opening into the bottom of said first convective cooler;

f. a radiant cooler comprising a cylindrical pressure containment vessel disposed upstream with respect to gas flow of said first vessel, having a gas inlet at the bottom thereof, a gas outlet at the top thereof;

g. a plurality of heat exchange tubes lining the interior of said radiant cooler thereby defining a radiant cooling chamber for cooling the hot gas;

h. means for conveying the gas from the gas outlet of said radiant cooler to the gas inlet of said first convective cooler;

i. a second convective cooler comprising a cylindrical pressure containment vessel disposed downstream with respect to gas flow of said first convective cooler, having a gas inlet at the top thereof, and a gas outlet at the bottom thereof;

j. means for conveying the gas from the gas inlet of said second convective cooler being connected to the gas outlet of said first convective cooler;

k. a third in-line tube bundle disposed in the gas pass of said second convective cooler; and l. means for receiving ash particles precipitating out of the hot gas flowing thru said second convective cooler, said means disposed beneath, secured to and opening into the bottom of said second convective cooler.

2. A steam generating heat exchanger as recited in claim 1, wherein the cross-sectional area encompassed by the cylindrical pressure containment vessel of said first convective cooler is 10 to 20 percent of the cross-sectional area of the radiant chamber defined by the cylindrical pressure containment vessel of said radiant cooler.

3. A steam generating heat exchanger as recited in claim 2, wherein:

a. the first in-line tube bundle disposed in the first gas pass of said first convective cooler is a superheater;

b. the second in-line tube bundle disposed in the second gas pass of said first convective cooler is an evaporator; and c. the third in-line tube bundle disposed in the gas pass of said second convective cooler is an economizer.

* * * * *